US007841033B2

(12) United States Patent
Schaub et al.

(10) Patent No.: US 7,841,033 B2
(45) Date of Patent: Nov. 30, 2010

(54) METHOD FOR CLEANING AND WATERPROOFING TEXTILES

(75) Inventors: Hartmut Schaub, Berlin (DE); Ingo Schulze, Panketal/Zepernick (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 645 days.

(21) Appl. No.: 11/795,304

(22) PCT Filed: Nov. 21, 2005

(86) PCT No.: PCT/EP2005/056096

§ 371 (c)(1),
(2), (4) Date: Jul. 12, 2007

(87) PCT Pub. No.: WO2006/079427

PCT Pub. Date: Aug. 3, 2006

(65) Prior Publication Data

US 2008/0115294 A1 May 22, 2008

(30) Foreign Application Priority Data

Jan. 26, 2005 (DE) ..... 10 2005 003 694

(51) Int. Cl.
*D06F 33/02* (2006.01)
*D06F 39/02* (2006.01)
*D06F 39/04* (2006.01)

(52) U.S. Cl. ..... 8/159; 68/12.18; 68/12.23; 68/15; 68/17 R

(58) Field of Classification Search ..... 68/12.01, 68/12.18, 12.23, 15, 17 R; 8/158, 159
See application file for complete search history.

(56) References Cited

U.S. PATENT DOCUMENTS 3,468,697 A 9/1969 Hunter
3,782,898 A 1/1974 Mandell, Jr.

(Continued)

FOREIGN PATENT DOCUMENTS

DE 35 27 724 2/1987

(Continued)

OTHER PUBLICATIONS

International Search Report PCT/EP2005/056096 mailed Mar. 17, 2006.

*Primary Examiner*—Joseph L Perrin
(74) *Attorney, Agent, or Firm*—James E. Howard; Andre Pallapies

(57) ABSTRACT

A method for cleaning and restoring a hydrophobic effect of textiles in a domestic washing machine in which hydrophobic substances dissolved in the washing liquid are contacted with the textiles during a treatment process. A washing process for cleaning the textiles while adding a special detergent is carried out in the presence of an inflow of fresh water, and at the end thereof, the used washing liquid is pumped off. The soapy water used for the preceding process is replaced and a multi-stage rinsing process is carried out for the textiles. After termination of the rinsing process, the last rinsing water is replaced and the hydrophobic substances are added to a newly supplied amount of fresh water, and a treatment process for waterproofing the textiles is carried out in an additive-containing washing liquid and the used additive-containing washing liquid is removed without repeating the rinsing process.

29 Claims, 2 Drawing Sheets

U.S. PATENT DOCUMENTS

| | | | | |
|---|---|---|---|---|
| 6,159,548 | A | 12/2000 | Moody | |
| 6,539,753 | B1 * | 4/2003 | Ito et al. | 68/3 R |
| 2003/0089138 | A1 * | 5/2003 | Kawamura et al. | 68/17 R |
| 2004/0148979 | A1 * | 8/2004 | No et al. | 68/23 R |

FOREIGN PATENT DOCUMENTS

| | | |
|---|---|---|
| DE | 42 06 135 | 9/1993 |
| EP | 0 244 900 | 11/1987 |
| EP | 0 548 035 | 6/1993 |
| EP | 0 597 509 | 5/1994 |
| EP | 0 913 117 | 5/1999 |
| GB | 2 168 388 | 6/1986 |
| GB | 2 208 659 | 4/1989 |
| GB | 2 378 960 | 2/2003 |

* cited by examiner

METHOD FOR CLEANING AND WATERPROOFING TEXTILES

The invention relates to a method for cleaning and establishing or restoring a hydrophobic effect of textiles in a domestic washing machine with facilities for heating a washing liquid present in an outer tub and for controlling treatment processes, as well as with detergent chambers, of which at least one is configured to hold an individual dose of a liquid detergent, with which method water-repelling agents dissolved in the washing liquid are brought into contact with the textiles during a treatment process similar to a washing process, with which method

- a washing process for cleaning the textiles is carried out with the addition of a special detergent, which in addition to its known dirt-removing effect is also suitable for removing any detergent agents still present from the textiles, into a quantity of fresh water flowing in, and at the end the used washing liquid is pumped away,
- after the end of the washing process a multi-stage rinsing process is carried out for the textiles, as the respective washing liquid of the previous process is replaced and
- after the end of the rinsing process (PhSp), as the last rinsing washing liquid is being replaced and the water-repelling agent is being added to a newly supplied quantity of fresh water, a treatment process is carried out to waterproof the textiles.

The invention also relates to a washing machine for implementing such a method.

BACKGROUND OF THE INVENTION

Such a method and washing machine are set out in EP 0 548 035 A1. This describes a method and washing machine for cleaning and establishing or restoring a hydrophobic effect of textiles. With the method a washing process, a multi-stage rinsing process and a treatment process for waterproofing the textiles are carried out.

According to GB 2 378 960 A textiles are washed and rinsed in a number of stages, with an agent, which makes the textiles repel marks, being added in the last rinse.

Functional textiles such as top clothing, which is worn for protection against moisture from the air, gradually lose their water-repellent property, their waterproofing, during use. It is possible to establish or restore this property by applying a water-repelling substance to the textile fibers. Generally this treatment is carried out on textiles in a commercial laundry or cleaning operation. However there is an increasing wish to be able to carry out such treatments in a domestic washing machine as well.

In the pertinent trade therefore water-repelling agents are available, which are suitable for use for waterproofing textiles in domestic washing machines. Such agents primarily consist of fluorocarbon resins or agents containing paraffin. The textiles to be waterproofed should be cleaned thoroughly beforehand in a separate wash program. Waterproofing is then carried out separately in the known manner in a standard washing process in a so-called long washing liquid, which is characterized in that a relatively large amount of washing liquid is used per kg of washing. A recommended quantity of water-repelling agent is thereby introduced into the main wash chamber of a detergent dispenser before the start of the standard washing process and supplied to the outer tub of the washing machine together with cold fresh water. The movement of the washing due to the rotation of the washing drum causes the waterproofing washing liquid to come into contact with the washing, while said waterproofing washing liquid is being heated by a heating device in the outer tub. The duration of this treatment is thereby predetermined by the program of the washing machine controller and is for example also defined by the reaching of the predetermined temperature of the waterproofing washing liquid. At the end of the washing process the washing is rinsed a number of times, so that the quantity of waterproofing agent attaching to the textile fibers of the washing is further reduced. The hydrophobic effect that can be achieved with the known method is therefore relatively minor. Also the process for establishing or restoring waterproofing is carried out completely separately from any other treatment process in the washing machine, so the user of the washing machine has to carry out the loading and setting operations twice and also has to wait for the full duration of both separate treatment programs.

SUMMARY OF THE INVENTION

The object of the invention is therefore to set down a method, which can be used in a domestic washing machine and with which the user of the washing machine has at their disposal a treatment sequence, with which the textiles can be both cleaned and waterproofed in a continuous processing program. Also the intention is to improve the hydrophobic effect that can be achieved significantly compared with the prior art with a continuous processing program.

According to the invention this object is achieved by the features set out in the exemplary embodiments in the manner that a washing process for cleaning the textiles is carried out with the addition of a special detergent, which in addition to its known dirt-removing effect is also suitable for removing any detergent agents still present from the textiles, into a quantity of fresh water flowing in, and at the end the used washing liquid is pumped away, that after the end of the washing process a multi-stage rinsing process is carried out for the textiles as the respective washing liquid of the previous process is replaced and that after the end of the rinsing process, as the last rinsing washing liquid is being replaced and the water-repelling agent is being added to a newly supplied quantity of fresh water, a treatment process is carried out to waterproof the washing.

With a generic method, according to the invention

- for a treatment process for waterproofing, the outer tub is filled with a quantity of water measured for a short washing liquid, in other words for a ratio of weight of the quantity of dry textiles to weight of the quantity of water of less than 1:8, and
- the washing liquid is heated to a temperature of at least 30° C., as the textiles are moved in the outer tub,
- before the water-repelling agent is added.

These measures mean that a user can load the batch of textiles to be washed into a washing machine, select and start the combined cleaning and waterproofing program. Said user need worry no further about the washing until the end of the waterproofing process.

All the above measures significantly increase the hydrophobic effect on the textiles. The high concentration of agent in the washing liquid improves the attaching behavior of the agent and avoids unnecessarily high agent consumption compared with long washing liquid. The introduction of the agent into already heated washing liquid prevents marks forming on the textiles and further improves the attaching behavior of the agent to the fibers. Good results are achieved with a treatment period of maximum 20 mins. Longer dwelling times waste energy without any additional benefits. Dispensing with subsequent rinses means there is no risk of diluting or washing away the agent from the textile fibers.

Advantageous developments of the inventive method are described in the subclaims and these can be used individually or in combination with each other.

According to the invention a washing machine for implementing the inventive method or one of its developments is also set down. This washing machine has input means, which can be used to select a program sequence for the washing machine, with which the method operates automatically and a control facility is provided, which is used to control the selected program sequence automatically, as soon as a start signal is present for this purpose.

BRIEF DESCRIPTION OF THE DRAWINGS

The invention is described below with reference to an exemplary embodiment illustrated in the drawing, in which.

DETAILED DESCRIPTION OF THE EXEMPLARY EMBODIMENTS OF THE PRESENT INVENTION

Figure 1:
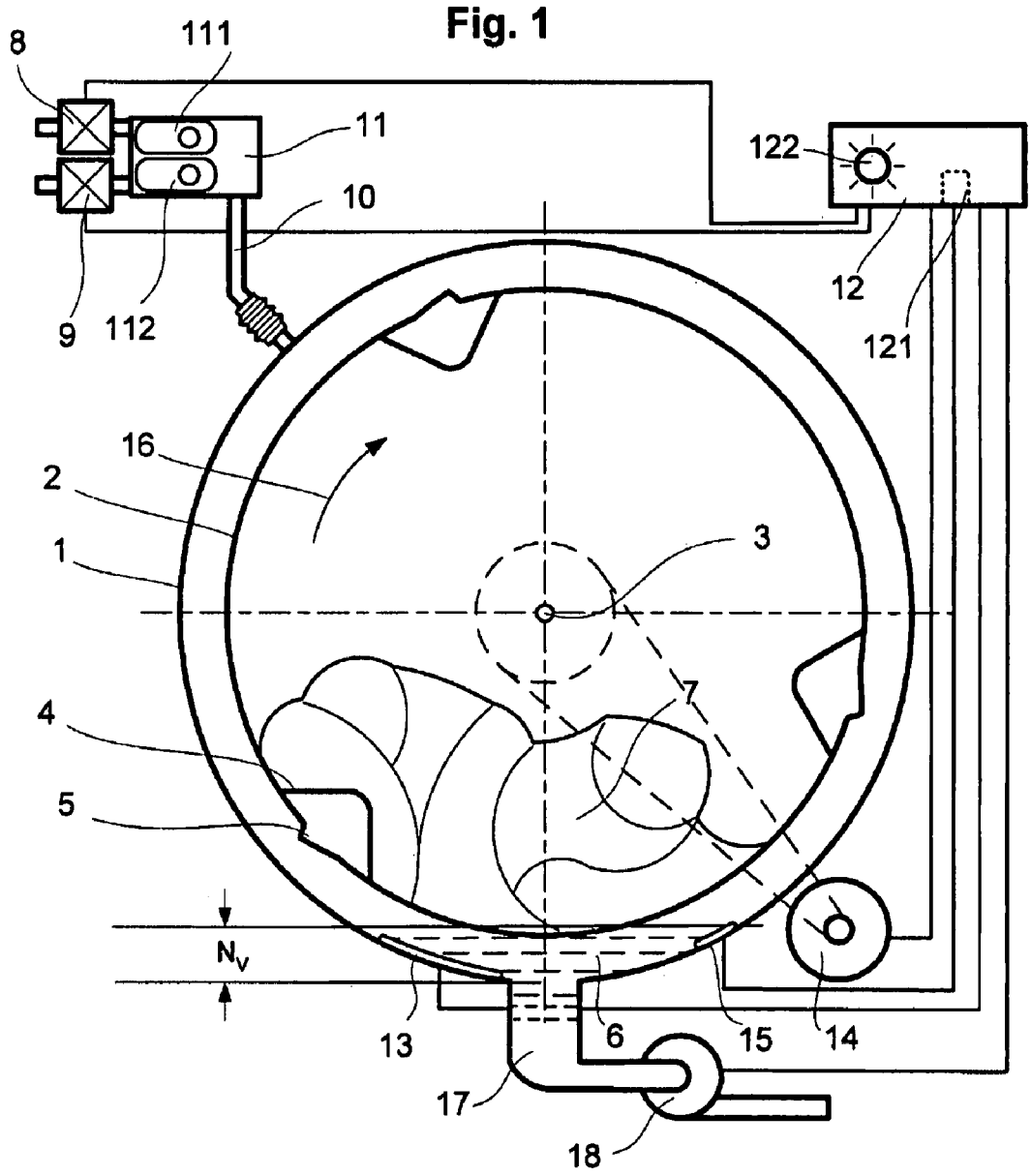
FIG. 1 shows a schematic diagram of a washing machine with an outer tub and a washing drum supported therein to hold textiles and FIG. 2 shows a diagram of the time sequence of a washing process as the first part of the complete run-through process according to the invention and FIG. 3 shows a diagram of the time sequence of the inventive method immediately following the washing and rinsing processes, to waterproof the textiles that have just been cleaned.

The outer tub 1 in FIG. 1 contains a washing drum 2 supported therein about a horizontal axis 3 and having agitators 4 for the washing 7, which consists of textiles. The agitators 4 have scooping facilities, which can be used to scoop washing liquid 6 from the bottom of the outer tub 1 during rotation of the washing drum 2 in the arrow direction 16 from a level $N_V$, which is above the lowest point of the washing drum 2, raise it to a level above the washing 7 and spray it down from there onto the washing 7. This accelerates the wetting and flow through the washing 7. An electric motor 14 serves to rotate the washing drum 2, inducing its rotational movement into the washing drum 2 by way of a belt drive.

A heating facility 13 is disposed at the base of the outer tub 1, serving to heat the washing liquid. This washing liquid 6 is introduced into the outer tub 1 by activation of one of the magnetic valves 8 or 9 and consists either only of water or a mixture of water and detergent. Two chambers 111 and 112 are shown in the detergent dispenser 11, through which fresh water flows respectively when the assigned magnetic valve is opened. Detergent in the chambers is then transferred by the water through the pipe 10 out of the detergent dispenser 11 into the outer tub 1. Washing liquid 6, which is at the bottom of the outer tub 1, can be conveyed out by the discharge pipe 17 and pump in a manner not shown in more detail here. All the switchable or controllable facilities, such as the magnetic valves 8 and 9, the heating facility 13, the drum drive motor 14 and the drain pump 18, are switched or controlled by the control facility 12 of the washing machine. A temperature sensor 15 is also used to measure the temperature of the washing liquid 6, transmitting its measurement signals by way of the control circuit to an evaluation facility 121 in the control facility 12.

The washing machine illustrated in FIG. 1 includes input means 122 are present, which can be used to preselect a program sequence for the washing machine, with which the method operates automatically. The control facility 12 controls the preselected program sequence automatically, as soon as a start signal is present for this purpose. The input means 122 can include, for example, one or more of a rotary selector, dial, input button, or other known input device or actuator, etc.

Figure 2:
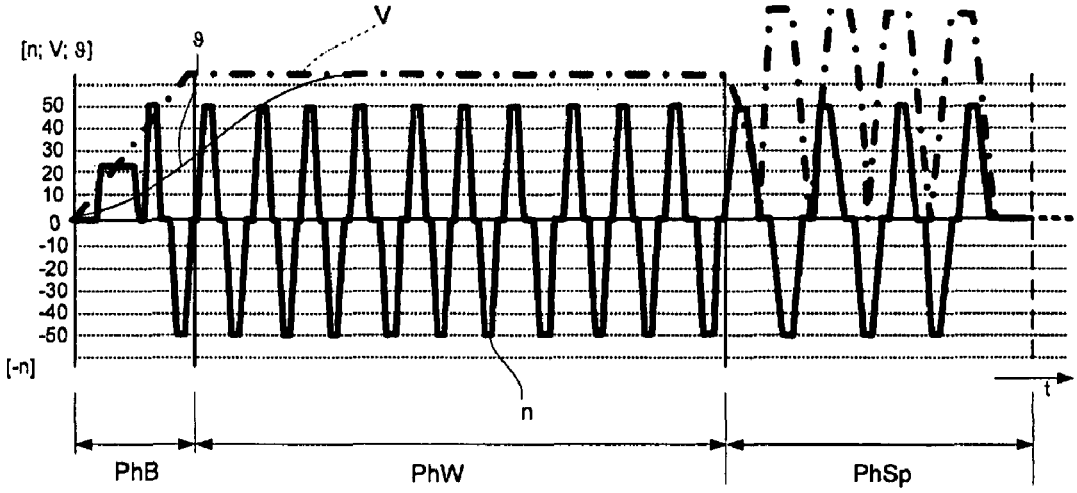
Figure 3:
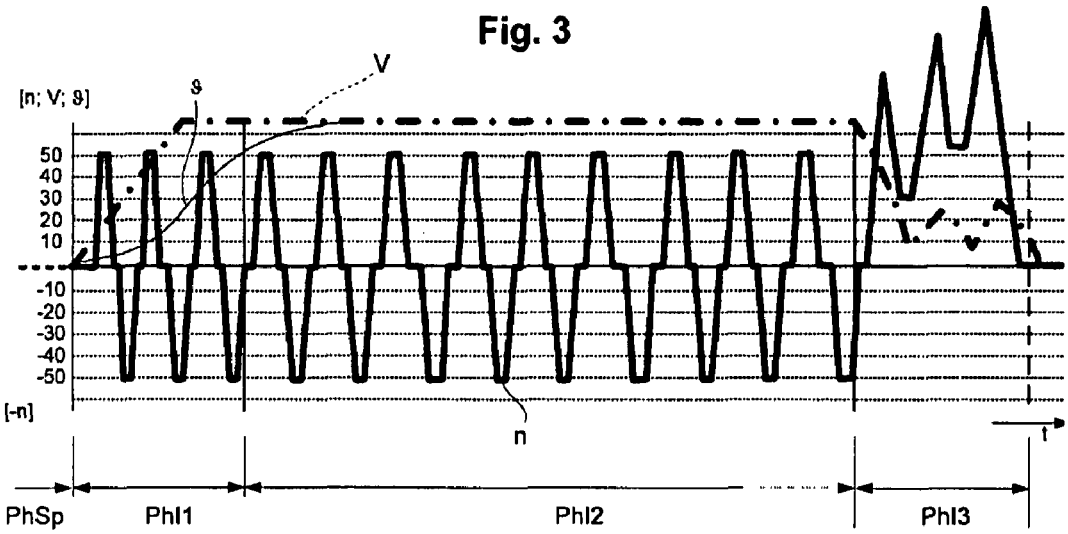

According to the invention the washing machine illustrated in FIG. 1 is for example operated in the manner illustrated in FIGS. 2 and 3. In the diagrams the scale on the ordinate only applies to the rotational speed of the washing drum 2; no scale is assigned to the other parameters. To operate the washing machine first the magnetic valve 8 is opened to introduce water by way of the detergent chamber 111—in this example filled with special detergent for the preparatory cleaning of items of washing to be waterproofed—and the pipe 10 into the outer tub 1. The water carries this special agent with it into the outer tub 1, where it is distributed.

Together they form the washing liquid. At the start of the washing process illustrated in FIG. 2, which consists of the three phases—PhB for wetting the washing, PhW for washing the washing and PhSp for rinsing the washing—the washing drum 2 is only driven at a rotational speed (e.g. 23 rpm), which is lower than is the case after wetting, according to the bold continuous line n on the diagram. Also in the wetting phase PhB the drum 2 is only driven in arrow direction 16, in which the scooping facilities 5 on the shell of the drum are fully effective.

During the washing phase PhW the washing drum 2 is driven in a constantly reversing manner, for example at 50 rpm, so that the washing comes into contact in an intensive manner with the washing liquid, which has already been heated in the wetting phase. At the end of the washing phase PhW the washing liquid is pumped away and replaced with a fresh water/washing liquid mixture. The inflowing water can for example be routed through the already emptied detergent chamber 111 for this purpose. The rinsing phase PhSp includes a number of stages, with repeated filling with fresh water, so that the washing liquid becomes very significantly diluted. In fact if possible there should be no special detergent residue remaining in the washing. The number of rinsing stages should therefore be adjusted to meet this requirement.

The processes described here can also be varied in phases PhB, PhW and PhSp according to current knowledge about the wetting, washing and rinsing of washing.

The waterproofing process follows immediately after the washing process according to FIG. 3. The quantity of water introduced in the first phase PhI1 is based on the batch of washing 7 in the washing drum 1 minus a quantity remaining in the washing from the rinsing process, and a further quantity required for the subsequent introduction of the water-repelling agent. This quantity of water passes once again by way of the magnetic valve 8 through the already emptied detergent chamber 111 into the outer tub, where it is first heated. Only when the washing liquid temperature reaches around 30° or 40° C. is the remaining quantity of water introduced by way of the now open magnetic valve 9, together with the water-repelling agent held in the detergent chamber 112, as a highly concentrated waterproofing washing liquid through the pipe 10 into the outer tub 1, forming there, together with the already heated washing liquid on its bottom, a level $N_V$, which the washing drum 2 at least touches. This allows the scooping facilities 5 on the washing drum 2 to pick up waterproofing washing liquid from the outer tub 1, as the drum starts to rotate, convey it upward and spray it down over the washing 7. The drum 2 is driven in a reversing manner so that the batch of washing does not become tangled. This drive mode is only shown schematically here and can be varied in any manner, to promote the flow through the washing.

At the end of the phase PhI1, in which the waterproofing washing liquid 6 (diagram line V) is heated in the outer tub, according to the thin diagram line θ before the addition of the water-repelling agent, by the heating facility 13 to a temperature of maximum 30° or 40° C., the waterproofing washing liquid is mixed thoroughly and distributed evenly in the batch of washing 7. Because the washing is pre-wet in the preceding rinse PhSp, when the water-repelling agent is added, the suddenly resulting concentration of the waterproofing washing liquid cannot adversely affect the washing 7; nor is it now likely to produce the otherwise possible marking caused by high concentrations of agent. During the phase PhI2, which now starts, the drum continues to be driven and pulls its scooping facilities 5 powerfully through the waterproofing washing liquid 6. As a result waterproofing washing liquid flows through the washing in an intensive manner for maximum 20 mins for example. Improved water-repelling agents also allow a shortened action period of less than 20 mins.

At the end of the phase PhI2—namely at the start of the phase PhI3—the drum movement initially ceases and the drain pump 18 starts to operate. This causes the free waterproofing washing liquid in the outer tub 1 to be sucked out through the discharge pipe by the pump 18 and drained away. Very soon after the pump starts to operate, the drum is switched to spin mode. In the diagram shown the high rotational speeds are shown compressed for reasons of space. However three spin pulses with respectively rising final rotational speeds can be identified, causing more and more bound washing liquid to be driven out of the washing. In the last spin interval the final spin speed can reach 800 rpm. The otherwise usual pre-rinse with clean water is intentionally dispensed with here, so that the maximum possible quantity of water-repelling agent, which is attached to the washing fibers, is retained there. During the spin intervals the drain pump 18 remains in operation, so that the washing liquid driven out of the washing is drained away quickly.

The invention claimed is:

1. A method for providing a hydrophobic effect for textiles in a domestic washing machine with facilities for heating a washing liquid in an outer tub and a washing drum and for controlling treatment processes, as well as with detergent chambers, of which at least one is configured to hold an individual dose of a liquid detergent, with which method water-repelling agents dissolved in the washing liquid are brought into contact with the textiles during a treatment process similar to a washing process, the method comprising the acts of: performing a washing process for cleaning the textiles with the addition of a special detergent, which in addition to its known dirt-removing effect is also suitable for removing any detergent agents still present from the textiles, into a quantity of fresh water flowing in, and at the end the used washing liquid is pumped away;

performing a multi-stage rinsing process for the textiles to replace the respective washing liquid of the previous washing process;

performing a treatment process to waterproof the textiles while replacing the last rinsing washing liquid;

adding the water-repelling agent to a newly supplied quantity of fresh water;

filling the outer drum with a quantity of water measured for a short washing liquid for a ratio of weight of the quantity of dry textiles to weight of the quantity of water of less than 1:8; and heating the washing liquid to a temperature of at least 30° C. while rotating the drum to move the textiles before the water-repelling agent is added.

2. The method as claimed in claim 1, wherein the special detergent includes a soap-based detergent.

3. The method as claimed in claim 1, wherein the special detergent includes a pH-neutral detergent.

4. The method as claimed in claim 1, wherein the rinsing process has at least three stages.

5. The method as claimed in claim 4, wherein the predetermined quantity of agent is adjusted to a concentration of maximum 30 g per liter of water.

6. The method as claimed in claim 1, wherein the act of adding the water-repelling agent includes rinsing a predetermined quantity of the water-repelling agent into the outer tub from the detergent chamber configured to hold liquid detergent, the water-repelling agent at least partially forming a waterproofing washing liquid together with the water.

7. The method as claimed in claim 6, wherein the textiles come into contact with the waterproofing washing liquid for a period of maximum 20 minutes in the treatment process.

8. The method as claimed in claim 6, further comprising removing the waterproofing washing liquid from the textiles and from the outer tub by spinning the washing drum without a further rinsing process.

9. The method as claimed in claim 6, wherein the period of the treatment process for the textiles with waterproofing washing liquid is less than about 15 minutes.

10. The method as claimed in claim 8, wherein after the treatment process for the textiles the free waterproofing washing liquid is first removed from the outer tub, before the waterproofing washing liquid bound in the textiles is removed from the textiles by spinning, during at least temporary active removal of the waterproofing washing liquid.

11. The method as claimed in claim 8, wherein more than one pulse-type spin is used to remove the waterproofing washing liquid from the textiles by spinning.

12. The method as claimed in claim 11, wherein at least three spins are used, each achieving a higher final speed than the previous one.

13. The method as claimed in claim 12, wherein the maximum speed during the final spin is about 800 rpm.

14. The method as claimed in claim 1, wherein the ratio of weight of the quantity of dry textiles to weight of the quantity of water is about 1:5.

15. A washing machine comprising:

an outer tub for retaining a washing liquid;

a washing drum disposed within the tub and mounted for rotation;

a heater for heating the washing liquid within the outer tub;

a control facility controlling operation of the washing machine;

a detergent chamber that receives a dose of a liquid detergent including water-repelling agents and that delivers the detergent to the outer tub at least partially forming the washing liquid with dissolved water-repelling agents;

and input means to preselect a program sequence for the washing machine, with which the program sequence operates automatically, wherein the program sequence includes:

performing a washing process for cleaning textiles in the washing drum by adding a special detergent, which in addition to having known dirt-removing effect also is suitable for removing any detergent agents still present from the textiles, into a quantity of fresh water flowing into the washing drum, wherein at an end the washing process used washing liquid is pumped away;

performing a multi-stage rinsing process for the textiles to replace the respective used washing liquid of the previous washing process;

performing a treatment process to waterproof the textiles while replacing the last rinsing washing liquid;

adding the water-repelling agents to a newly supplied quantity of fresh water;

filling the outer drum with a quantity of water measured for a short washing liquid for a ratio of weight of the quantity of dry textiles to weight of the quantity of water of less than 1:8; and heating the washing liquid to a temperature of at least 30° C. while rotating the drum to move the textiles before the water-repelling agent is added;

and wherein the control facility controls the preselected program sequence automatically, as soon as a start signal is present for this purpose.

16. The washing machine of claim 15, wherein the special detergent includes one of a soap-based detergent and a pH-neutral detergent.

17. The washing machine of claim 15, wherein the control facility controls the rinsing process such that the rinsing process includes at least three stages.

18. The washing machine of claim 15, wherein the act of adding the water-repelling agent includes rinsing a predetermined quantity of the water-repelling agent into the outer tub from the detergent chamber configured to hold liquid detergent, the water-repelling agent at least partially forming a waterproofing washing liquid together with the water.

19. The washing machine of claim 18, wherein the textiles come into contact with the waterproofing washing liquid for a period of maximum 20 minutes in the treatment process.

20. The washing machine of claim 18, wherein the washing drum removes the waterproofing washing liquid from the textiles and from the outer tub by spinning the washing drum without a further rinsing process.

21. The washing machine of claim 20, wherein after the treatment process for the textiles the free waterproofing washing liquid is first removed from the outer tub, before the waterproofing washing liquid bound in the textiles is removed from the textiles by spinning, during at least temporary active removal of the waterproofing washing liquid.

22. The washing machine of claim 20, wherein more than one pulse-type spin is used to remove the waterproofing washing liquid from the textiles by spinning.

23. The washing machine of claim 22, wherein at least three spins are used, each achieving a higher final speed than the previous one.

24. The washing machine of claim 23, wherein the maximum speed during the final spin is about 800 rpm.

25. The washing machine of claim 18, wherein the predetermined quantity of agent is adjusted to a concentration of maximum 30 g per liter of water.

26. The washing machine of claim 18, wherein the period of the treatment process for the textiles with waterproofing washing liquid is less than about 15 minutes.

27. The washing machine of claim 15, wherein the ratio of weight of the quantity of dry textiles to weight of the quantity of water is about 1:5.

28. The washing machine of claim 15, wherein the chamber includes a detergent chamber portion that receives the dose of the liquid detergent and a water-repelling agent chamber portion that receives the water-repelling agents.

29. A domestic washing machine comprising:

an outer tub for retaining a washing liquid;

a washing drum for receiving textiles to be treated with water-repelling agents, the washing drum disposed within the tub and mounted for rotation;

a heater for heating the washing liquid within the outer tub;

a control facility that controls operation of the washing machine;

a chamber including a detergent chamber portion that receives a dose of a liquid detergent and a water-repelling agent chamber portion that receives the water-repelling agents, wherein the detergent chamber delivers the liquid detergent and the water-repelling agents to the outer tub at least partially forming a washing liquid with dissolved water-repelling agents; and an input device in communication with the control facility, wherein the input device, upon actuation, preselects a program sequence that automatically treats the textiles in the washing drum with the water-repelling agents, wherein the program sequence includes:

performing a washing process for cleaning the textiles in the washing drum by adding a special detergent, which in addition to having known dirt-removing effect also is suitable for removing any detergent agents still present from the textiles, into a quantity of fresh water flowing into the washing drum, wherein at an end the washing process used washing liquid is pumped away;

performing a multi-stage rinsing process for the textiles to replace the respective used washing liquid of the previous washing process;

performing a treatment process to waterproof the textiles while replacing the last rinsing washing liquid;

adding the water-repelling agents from the water-repelling agent chamber portion to a newly supplied quantity of fresh water;

filling the outer drum with a quantity of water measured for a short washing liquid for a ratio of weight of the quantity of dry textiles to weight of the quantity of water of less than 1:8; and heating the washing liquid to a temperature of at least 30° C. while rotating the drum to move the textiles before the water-repelling agent is added; and wherein the control facility automatically controls the preselected program sequence upon receipt of a start signal from the input device.

* * * * *